United States Patent [19]

Kieffer

[11] Patent Number: 4,748,303

[45] Date of Patent: May 31, 1988

[54] ISOLATING SWITCH OF A HIGH VOLTAGE METALCLAD INSTALLATION

[75] Inventor: Jean Kieffer, Crolles, France

[73] Assignee: Merlin Gerin, Grenoble Cedex, France

[21] Appl. No.: 940,109

[22] Filed: Dec. 10, 1986

[30] Foreign Application Priority Data

Dec. 20, 1985 [FR] France ..... 85 19216

[51] Int. Cl.[4] ..... H01H 33/60

[52] U.S. Cl. ..... 200/148 B; 200/148 H; 200/148 R

[58] Field of Search ..... 200/148 B, 148 H, 148 R

[56] References Cited

U.S. PATENT DOCUMENTS

| | | | |
|---|---|---|---|
| 3,185,802 | 5/1965 | Amalric | 200/148 B |
| 4,236,053 | 11/1980 | Sasaki et al. . | |
| 4,525,612 | 6/1985 | Kawashima | 200/148 B |
| 4,659,886 | 4/1987 | Olsen et al. | 200/148 R |

FOREIGN PATENT DOCUMENTS

| | | |
|---|---|---|
| 0040781 | 12/1981 | European Pat. Off. . |
| 744144 | 5/1943 | Fed. Rep. of Germany . |
| 2558301 | 6/1971 | France . |

*Primary Examiner*—Robert S. Macon

*Attorney, Agent, or Firm*—Parkhurst & Oliff

[57] ABSTRACT

An isolating switch of a metalclad installation having an earthed metal enclosure is filled with a high dielectric strength gas. The isolation gap "d" separating the stationary contact from the movable sliding pin is surrounded by an annular electrode fitted between this isolation gap "d" and the enclosure. The annular electrode extends over the whole length of the isolation gap "d" and is electrically connected to the stationary contact to prevent any migration of the arc drawn between the contacts towards the earthed enclosure. The metal enclosure is advantageously spherical in shape, the contacts being disposed appreciably in the center of the sphere.

6 Claims, 1 Drawing Sheet

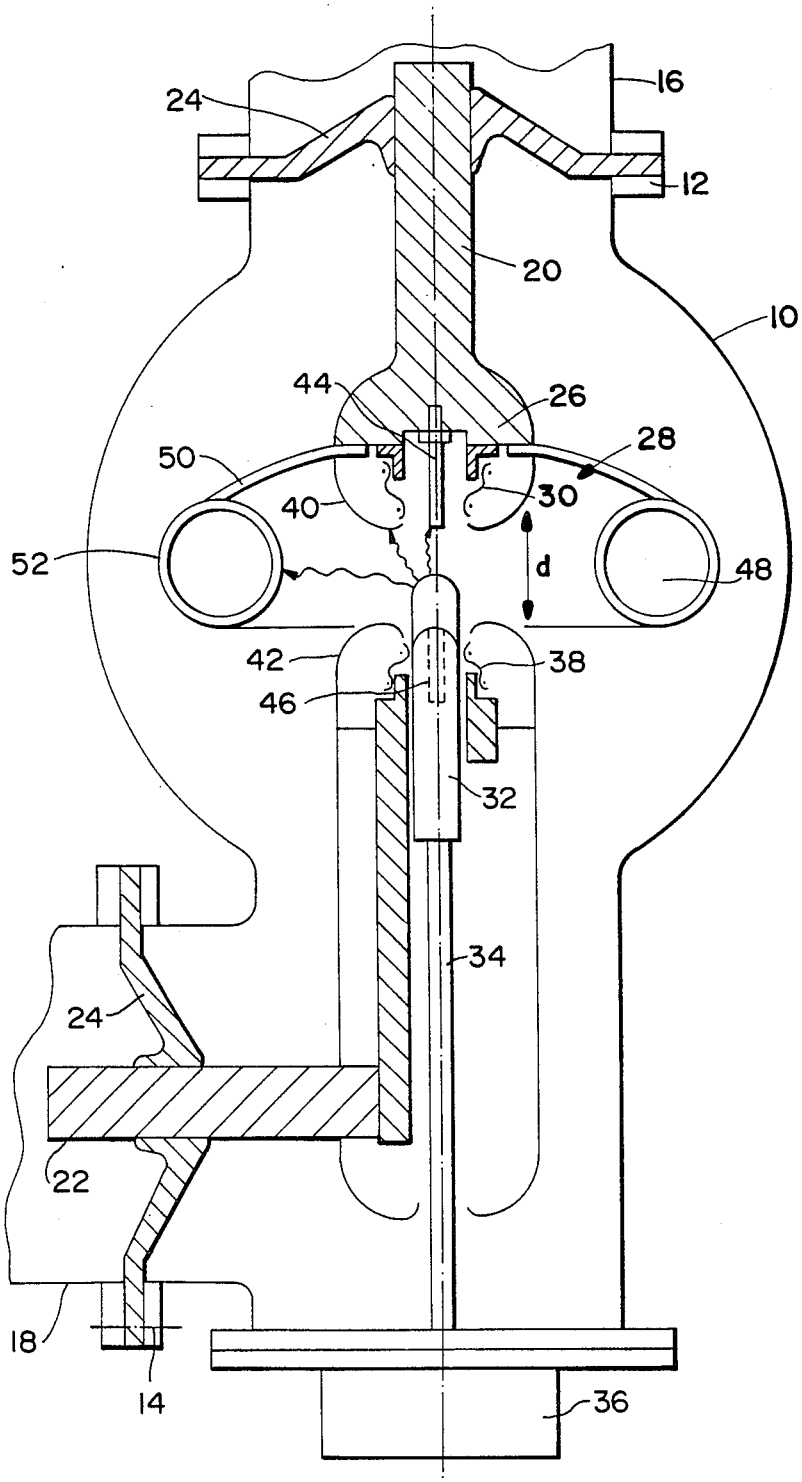
24
16
12
20
10
44
26
28
50
30
40
52
d
48
42
38
46
32
34
24
22
18
14
36

ISOLATING SWITCH OF A HIGH VOLTAGE METALCLAD INSTALLATION

BACKGROUND OF THE INVENTION

The invention relates to an isolating switch of a metalclad installation with an annular earthed metal enclosure filled with a high dielectric strength gas, comprising:

a movable contact in the form of a sliding pin, capable of moving to a closed position engaged with an aligned stationary contact, and to an open position separated from said stationary contact by an isolation gap "d", a field distribution shield in the form of a fixed cover covering the end of the stationary contact to which it is electrically connected and having a central opening for the movable contact pin to pass through in the closed position of the isolating switch, a field distribution shield in the form of a cover associated with the movable contact and arranged to cover the end of the movable contact in the open position, and electrically connected to the movable contact.

PRIOR ART

An isolating switch of the kind mentioned makes it possible to isolate a part of the installation or a feeder, notably of a metalclad substation, operation of the isolating switch taking place off-load. An isolating switch of this kind may have to interrupt capacitive or inductive currents of low power, but sufficient to draw an arc between the isolating switch contacts. Such an arc is quickly extinguished in the course of continued operation of the isolating switch and is of no consequence when it remains confined in the contact separation zone. It has been noted that in a metalclad installation comprising an earthed metal enclosure, the arc drawn between the isolating switch contacts is liable under certain severe conditions to migrate towards the enclosure and bring about an internal arc breakdown to earth. To avoid these drawbacks, it has already been proposed to limit the arc duration by high-speed contact operation or to keep the arc in the central part by means of field distribution shields. These solutions prove satisfactory for some operating conditions, but they do not ensure absolute reliability.

The object of the present invention is to enable an isolating switch to be achieved avoiding any flashover to the earthed enclosure, when the isolating switch operates.

SUMMARY OF THE INVENTION

The isolating switch according to the invention is characterized by the fact that it comprises an annular electrode disposed coaxially around said isolation gap "d", and fitted between this gap and the metal enclosure to pick up an arc liable to migrate from said gap to said enclosure.

Surrounding the arc zone by an electrode connected to the stationary contact does not prevent either the formation of the arc of its possible migration, but this migration is then directed towards this electrode, preventing a flashover on the earthed enclosure. The annular electrode is at a sufficient distance from the movable contact and the parts at the potential of this contact to preserve the isolation voltage. The annular electrode is also at a sufficient distance from the earthed metal enclosure to avoid any breakdown between this electrode and the enclosure. To this end, the metal enclosure advantageously presents a sufficiently enlarged cross-section at the level of the annular electrode to ensure the dielectric withstand of the installation. The enclosure may be spherical or of enlarged cross-section cylindrical shape, connected by cone-shaped parts to the cylindrical sheaths of the installation.

The length of the annular electrode corresponds appreciably to the separation length of the contacts to avoid the arc being drawn towards the earthed enclosure. The edges of the annular electrode are rounded to ensure a good distribution of the field and to limit the risks of flashover occurring. The electrode is preferably in the shape of a ring, for example a circular section toroid, coaxially surrounding the isolating switch contacts. The annular ring is secured to the stationary contact by means of arms at the same time providing the electrical connection, these arms being tangentially connected to the external part of the ring. The arms may belong or be replaced by a solid spherical portion forming an actual shield between the stationary contact and the annular electrode preventing the arc from passing through this gap.

BRIEF DESCRIPTION OF THE DRAWINGS

Other advantages and characteristics will become more clearly apparent from the following descrition of an embodiment of the invention, given as an example only, and represented in the single accompanying drawing, which is an axial section of an isolating switch according to the invention, represented in the course of opening of the contacts.

DESCRIPTION OF THE PREFERRED EMBODIMENT

In the FIGURE, a sealed and earthed metal enclosure 10 if filled with a high dielectric strength gas, notably sulphur hexafluoride. The enclosure 10 has connection flanges 12, 14, to cylindrical sheaths 16, 18, belonging to the enclosure of a metalclad substation. The sheaths 16, 18, coaxially surround conductors or bars 20, 22, supported by insulators 24, fitted between the flanges 12, 14. In the example illustrated by the FIGURE, the bars 20, 22, are perpendicular, but it is clear that the invention applies to bars which are either aligned or extending in oblique directions. The end 26 of the bar 20 inside the enclosure 10 bears a stationary contact 28 having contact grips 30, arranged in the shape of a tulip to coaxially surround a movable contact 32, in the shape of a sliding pin. The pin 32 is connected by a rod 34 to an operating mechanism 36 capable of axially moving the pin 32 selectively to a closed drawin-in position between the stationary contact grips 30 and an open position of the isolating switch at a distance "d" from the stationary contact 28. The pin 32 is electrically connected by friction contacts 38 to the end of the bar 22 inside the enclosure 10. The stationary contact 28 and the movable contact 32 are each equipped with a hemispherical-shaped cover 40, 42, ensuring a good distribution of the field around these contacts. The covers 40, 42, present an axial opening for the contact pin 32 to pass through. The stationary contact 28 can in addition have an arcing finger 44 disposed axially between the contact grips 30 and extending up to the edges of the cover 40. The sliding pin 32, when the finger 44 exists, has a conjugate internal recess in which the finger 44 enters in the closed position of the isolating switch. An isolating switch of this kind, well known in the art, enables the connection between the conductors 20, 22, to be made or broken by simple sliding of the moving pin 32, actuated by the operating mechanism 36.

According to the invention, the metal enclosure 10 is spherical in shape and has a greater cross-section than that of the sheaths 16, 18, and the stationary contact 28, movable contact 32 assembly is located appreciably in the centre of this sphere. An annular electrode 48, in the form of a toroid, is disposed in the diametrical plane of the sphere 10, perpendicular to the movable contact pin 32, coaxially surrounding the gap "d" separating the stationary contact 28 and the movable contact 32. The annular electrode 48 is fitted between the metal enclosure 10 and the separating gap "d" which constitutes the arc formation zone, when a capacitive or inductive current is interrupted. The diameter of the toroid 48 is appreciably equivalent to the isolation distance "d" between the stationary contact 28 and movable contact 32 in the separated position. The annular electrode 48 is secured by arms or a spherical portion 59 to the stationary contact 28. These arms are connected tangentially to the outer edges 52 of the toroid to present a rounded shape avoiding any concentration of the electrical field. The opposite ends of the arms 50 are secured to the rear of the stationary contact 28 shielded by the distribution cover 40. The arms 50 provide the mechanical support of the annular electrode 48 and its electrical connection to the stationary contact 28. Referring to the FIGURE, it can be seen that the distance separating the annular electrode 48 from the movable contact 32 and from the distribution cover 42 is always greater than or equal to the isolation distance "d" separating the stationary contact 28 from the movable contact 32 in the open position, so as to ensure a sufficiently high dielectric withstand. Similarly, the annular electrode 48 is sufficiently far from the earthed metal enclosure 10 to avoid any breakdown between this electrode and the enclosure 10.

Operation of the isolating switch can be understood from the foregoing description:

in the open position of the isolating switch, the pin 32 is engaged between the grips 30 of the stationary contact 28 and provides the connection between the bars 20, 22. Opening of the isolating switch is controlled by the mechanism 36 which imposes a downwards sliding movement of the pin 32 in the FIGURE. When the contacts 28, 32 separate, an arc flashes over between the arcing finger 44 and the end of the pin 32, in the manner represented in the FIGURE, this arc (or a secondary arc arising from the first one) being liable to migrate onto the distribution cover 40 and thence onto the annular electrode 48. It can easily be seen that the electrode 48 prevents any passage of the arc to the metal enclosure 10, notably between the stationary contact 28 and the electrode 48, the distance to be covered to reach the earthed enclosure 10 always being greater than that to reach the electrode 48 or the distribution cover 40. The spherical portion 50 which may be solid or perforated to form support arms, constitutes an additional barrier. Any risk of earthing is thus avoided.

The metal enclosure 10 may be shaped as an ellipsoid or a cylinder associated with cone-shaped any other shaped connection parts. The cross-section of the annular electrode 48 may be flattened to form an oval or a simple cylinder if care is taken to provide the edges with a bulging part to avoid any point liable to provide a concentration of the field lines. Referring to the FIGURE, it can be seen that the internal part of the annular electrode 48, disposed facing the stationary contact 28, is of very little use and that it can be omitted, the electrode 48 in this case comprising a rounded part formed by a fold of the edge of the spherical portion 50. Other operative forms of an annular electrode 48 of this kind can easily be imagined by those skilled in the art. The arrangement according to the invention requires a larger volume, but this increase is greatly counterbalanced by the safety ensured by the electrode 48 which forms an almost impassable barrier for the arc. In the case of an enclosure of sufficient diameter, it is obviously pointless increasing the cross-section of the enclosure at right-angles to the annular electrode 48. Securing and electrical connection of the annular electrode 48 can be accomplished differently and independently from one another, the invention naturally being extended to cover any alternative arrangements which remain within the scope of equivalent embodiments.

What I claim is:

1. An isolating switch of a metalclad installation with an annular earthed metal enclosure filled with a high dielectric strength gas, comprising:

a movable contact in the form of a sliding pin capable of moving to a closed position engaged with an aligned stationary contact, and to an open position separated from said stationary contact by an isolation gap, a field distribution shield in the form of a fixed cover covering the end of the stationary contact to which it is electrically connected and having a central opening for the movable contact pin to pass through in the closed position of the isolating switch, a field distribution shield in the form of a cover associated with the movable contact and arranged to cover the end of the movable contact in the open position, and electrically connected to the movable contact, and an annular electrode in the shape of a ring having its axis aligned with said movable and stationary contacts, said annular electrode being disposed coaxially around said isolation gap between said movable and stationary contacts, and fitted between the isolation gap and the earthed metal enclosure to pick up an arc liable to migrate from said gap to said enclosure, said annular electrode being electrically connected to the stationary contact and having an axial length equivalent to that of said gap so as to surround said gap over its entire axial length, said enclosure having an enlarged cross-section at the level of said annular electrode to ensure a sufficient dielectric withstand between the enclosure and the annular electrode.

2. An isolating switch according to claim 1, wherein said enclosure is spherical in shape, and said contact assembly is disposed appreciably in the center of the spherical enclosure.

3. An isolating switch according to claim 1, wherein said electrode is a toroid of circular cross-section.

4. An isolating switch according to claim 1, wherein said annular electrode is fitted with support and electrical connection arms secured to said stationary contact shielded by the field distribution cover.

5. An isolating switch according to claim 4, wherein said arms form a solid or perforated spherical portion whose circular edge is tangentially connected to the external surface of the annular electrode.

6. An isolating switch according to claim 1, wherein said stationary contact comprises contact grips circumferentially surrounding said pin in the closed position and an arcing finger extending axially up to the central opening of the field distribution cover, capable of engaging in a conjugate axial orifice of the movable pin in the closed position.

* * * * *